US007140938B1

(12) United States Patent
Ware

(10) Patent No.: US 7,140,938 B1
(45) Date of Patent: Nov. 28, 2006

(54) SWIM ASSIST SYSTEM AND METHOD

(76) Inventor: Paul Ware, 18340 Ospey Ct., Mt. Vernon, WA (US) 98274

( * ) Notice: Subject to any disclaimer, the term of this patent is extended or adjusted under 35 U.S.C. 154(b) by 0 days.

(21) Appl. No.: 11/112,233

(22) Filed: Apr. 21, 2005

Related U.S. Application Data

(60) Provisional application No. 60/565,165, filed on Apr. 23, 2004.

(51) Int. Cl.
*A63B 31/08* (2006.01)

(52) U.S. Cl. ..... 441/64

(58) Field of Classification Search ..... 441/61, 441/62, 63, 64; D21/806
See application file for complete search history.

(56) References Cited

U.S. PATENT DOCUMENTS

| | | | | |
|---|---|---|---|---|
| 2,343,468 | A | 3/1944 | Messinger | |
| 2,980,926 | A | 4/1961 | Wolshin | |
| 3,521,312 | A | 7/1970 | Ganey | |
| 4,599,071 | A | 7/1986 | Juang | |
| 5,041,039 | A | 8/1991 | Chang | |
| 5,766,050 | A | 6/1998 | Maggi | |
| 5,924,902 | A | 7/1999 | Burns et al. | |
| 5,941,747 | A | 8/1999 | Garofalo | |
| 6,322,412 | B1 * | 11/2001 | Viale | 441/64 |
| 6,375,531 | B1 * | 4/2002 | Melius | 441/64 |
| 6,394,863 | B1 * | 5/2002 | Chen | 441/64 |
| 6,398,605 | B1 | 6/2002 | Gibbons et al. | |

* cited by examiner

*Primary Examiner*—Lars A. Olson
(74) *Attorney, Agent, or Firm*—Robert B. Hughes; Hughes Law Firm, PLLC

(57) ABSTRACT

A swim assist apparatus which comprises a fin member which is connected to a sandal by having forward connecting strap portions of the sandal engaging retaining recesses in the fin member. The fin member has a rear mounting portion positioned at an upper forward surface portion of a sole of the sandal and a forward fin portion which extends outwardly from the mounting portion. The retaining recesses have forward and rear surfaces which limit front to rear and motion of the fin member relative to the sole of the sandal to limit relative movement between the sandal and the fin member.

20 Claims, 5 Drawing Sheets

SWIM ASSIST SYSTEM AND METHOD

RELATED APPLICATIONS

This application claims priority benefit of U.S. Ser. No. 60/565,165, filed Apr. 23, 2004.

BACKGROUND OF THE INVENTION a) Field of the Invention

The present invention relates generally to swim assist systems, and more particularly to such a system where fin or fin-like members are mounted to the person's feet so that these assist in the paddling motion when the person's feet move back and forth while swimming.

b) Background Art

In the last several decades, it has been common for swimmers to get a greater propulsive force from the paddling motion of their feet during swimming by adding fins to the person's feet. The traditional way of mounting these fins is to have two rubber fin members that have a mounting portion which fits over the forward part of the person's foot, along with a strap extending around the person's heel. There have been various designs proposed by which such fin members or the like can be mounted to the person's footwear in some manner.

The embodiments of the present invention are directed toward this general type of swim assist system.

EMBODIMENTS OF THE PRESENT INVENTION

Figure 1:
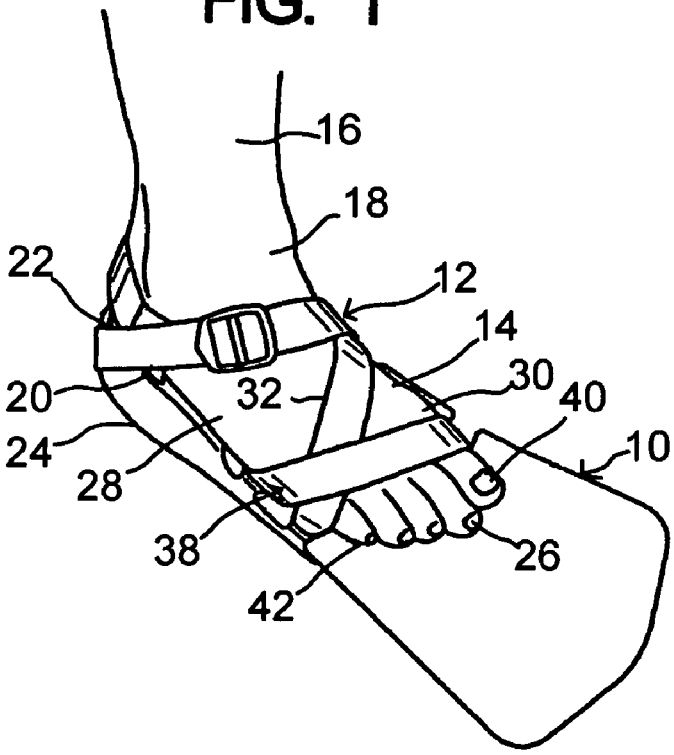
FIG. 1 is an isometric view showing a system of a first embodiment of the present invention where there is a sandal on the person's foot and a fin member mounted at a location between the forward part of the person's foot and the sandal.
Figure 2:
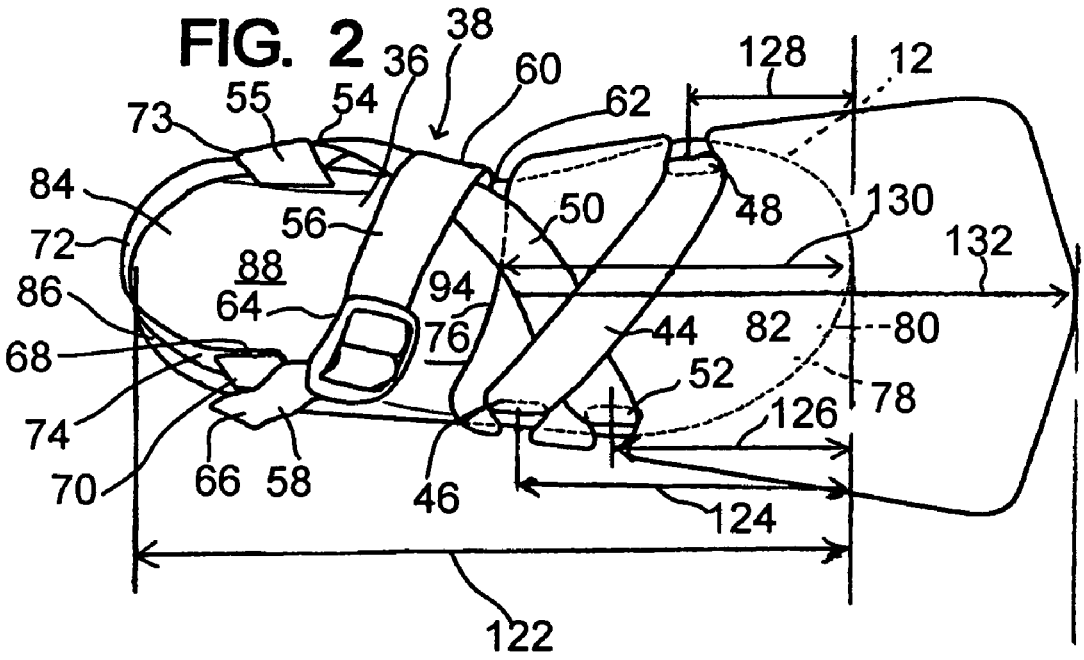
FIG. 2 is a top plan view showing the sandal and the fin member mounted to the sandal.
Figure 3:
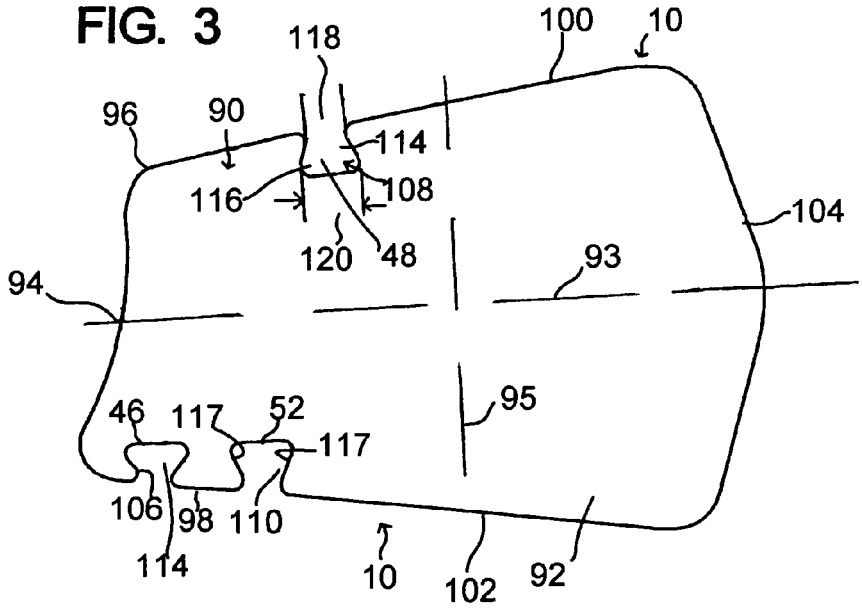
FIG. 3 is a plan view showing the fin member by itself.

A first embodiment of the present invention is illustrated in FIGS. 1, 2 and 3. As can be seen in FIG. 1, there is a swim assist member, which will be termed a "fin member 10", mounted to an item of footwear 12, with a person's foot 14 being positioned in the footwear 12.

It is believed that a clearer understanding of the embodiments of the present invention will be obtained by preceding a detailed description of the embodiments of the invention with a discussion of the terminology which is to be used with reference to the person's foot 14 and the footwear 12.

With further reference to FIG. 1, there is a person's ankle 16, joined to the foot 14 at a juncture location, with the forward portion of this juncture location being indicated at 18. Attached to and positioned below the lower end of the ankle 16 is the person's calcaneus of the foot, which is commonly referred to as the person's heel, which is given the numerical designation 20. The heel 20 has a rear heel surface portion 22 and a bottom heel surface portion 24. At the front of the person's foot are the person's toes 26, and that portion of the foot positioned between the heel portion 20 and the toes 26 is the metatarsus 28. The metatarsus 28 joins the toes 26 at a forward metatarsal juncture location at the general location shown at 30. The metatarsus 26 has an upper metatarsal surface 32 which comprises a forward metatarsal/toe surface portion at or adjacent to the region of the metatarsal juncture location 30. The bottom surface portion of the foot at the metatarsal juncture location is commonly called the "ball" of the foot.

The item of footwear 12 that is illustrated in FIGS. 1 and 2 is generally referred to as a sandal, and it commonly comprises a sole 36 which extends substantially beneath the entire surface lower surface of the person's foot 12 and a strap assembly 38 to hold the sandal against the person's foot. For convenience, the particular item of footwear 12 which is shown in FIGS. 1 and 2 shall be termed a "sandal" 12, with the understanding that this term is intended to include various items of footwear that may not technically be called "sandals" in present day fashion terminology, but is to pertain more broadly to footwear where there is the sole 36 and also straps or strap-like members of a configuration that would extend over surface portions of the person's foot so that the sole is properly positioned and securely held relative to the person's foot. The sandal 12 of this first embodiment is a commercially available sandal.

In FIGS. 1 and 2, the sandal 12 is configured to fit on a person's right foot. For convenience of description, the portion of the sandal 12 that is on the same side of the foot 14 as the person's big toe 40 shall be considered the left part of the person's foot and the side of the sandal 12 that is adjacent to the person's little toe 42 will be called the left side of the sandal 12. It is to be understood, of course, that the description relative to the sandal 12 shown in FIGS. 1 and 2 would apply just as well to the left sandal, but with the right and left locations reversed. In broader terminology the term "inner" or "inner portion" shall refer to that portion of the sandal 12 or foot 14 that is on the left as seen in FIG. 1 and the term "outer" or "outer portion" shall be considered to be the right side of the person's foot or sandal as shown in FIG. 1.

The term "forward" shall denote a direction toward, or a location at or adjacent to, the part of the person's foot or sandal that is at or near the person's toes 26, while the term "rear" will refer to the direction toward, or a location at or near to the heel 20 of the person's foot 12.

The sandal 12 that is shown in FIGS. 1 and 2 is currently available to the public and the fin member 10 is arranged so as to inter-fit with this sandal 12 in an operating position. The strap assembly 38 of the sandal 12 comprises a first forward strap portion 44 extending over the metatarsal/toe surface portion at 30 (or adjacent thereto) having right and left connecting locations 46 and 48 where the forward strap 44 engages edge portions of the sole 36 and extends from left to right in a rearward slant. There is a second forward strap portion 50 that extends from a right connecting location 52 that engages the right edge portion of the sole 36 at a location forward of the location 48 and extends over the upper metatarsal surface 32 in a right to left rearward slant to a second left edge connecting location 54 at which it connects to a first flexible connecting piece 55 that in turn connects to a rear left side portion of the sole 36.

There is an intermediate strap portion 56 which functions as a rear upper foot surface engaging portion 56 and comprises right and left strap portions 58 and 60 respectively. The left strap portion 60 has a first connecting location 62 at a left edge portion of the sole 36, with the opposite end connecting to a buckle 64. The right strap portion 58 has a free end 66 which removably connects to the buckle 64. This buckle 64 is a type of buckle where the strap portion 58 goes through one slot opening in the buckle, then through a 180 degree curve through a second slot opening so that the free end portion 66 of the right strap portion 58 can be pulled relative to the buckle 64 to slide the strap portion 58 in the buckle 64 to tighten the two strap portions 58 and 60. The strap portions 58 and 60 can also be loosened by manipulating the free end portion 66 of the strap portion 58 into the buckle 64.

The right free strap portion 58 has a connecting location 68 at which it connects to a second flexible connecting piece 70 that is connected to a rear right edge portion of the sole 36 and extends a short distance upwardly therefrom. There is a back strap portion 72 which has two connecting ends 73 and 74, with the connecting end 73 connecting to the first flexible connecting piece 55 and a second connecting end 74 connecting to the second flexible connecting piece 70.

The first forward strap portion 44, the second forward strap 50, the back strap 72, and the right connecting strap portion 58 can be made as one continuous strap member. This is accomplished by having the first portion strap portion 44 having a fixed connection to a right middle side portion of the sole at the connection location 46, with this first strap portion 44 then extending to the left forward location 48 into a slot-like passageway which extends from the location 48 through the interior of the sole 36 to the connecting location 52, where it has a slide connection and continues on to extend further as part of the continuous strap member as the second strap forward portion 50 to connect to the flexible connecting piece 55.

At the connecting location 54 of the second forward portion 50 to the flexible connecting piece 55, the back strap portion 72 has a fixed connection (e.g. by sewing) to the flexible connecting piece 55. The back strap portion 72 being formed as a continuous strap portion with the strap portion 50, extends around the back surface 22 of the heel 20 and connects at the connecting location 74 to the second flexible connecting piece 70 and also connects to the strap portion 58 as another portion of the continuous strap. The flexible connecting piece 70 is sewn to the continuous strap at the connecting location of the strap portions 72 and 58. The right strap portion 58 is the end portion of the continuous strap.

The left intermediate strap portion 60 is not part of the continuous strap, but is a single strap member which has a fixed connection at 62 to the left side portion of the sole 36, and as indicated earlier has it's other end connecting to buckle 64. Obviously the arrangement of the fixed connecting locations and the slide connecting locations could be modified to other arrangements.

When the person's foot is placed into the strap assembly 38 so that the foot rests on the sole 36 of the sandal 12, the initial step in securing the foot 14 in the sandal 36 is to insert the free end of portion 66 of the right strap portion 58 through the buckle 64 and then pull the free end strap portion 66 so as to tighten the two piece intermediate strap 56 that is made up of strap portions 58 and 60. The tension force applied to the right strap portion 58 acts through the second flexible connecting piece 70 to apply a tension force to the back strap portion 72 which in turn applies a tension force at the first flexible connecting piece 55 to exert a tension force on the second forward strap portion 50. The second forward strap portion strap 50 acts through the concealed connecting strap portion that is located in the slot-like passageway that extends through the forward part of the sole 36 to in turn exert a tension force on the first forward strap 44. The tension force on the forward strap 44 is reacted to the connecting location 46 which is anchored into the right middle edge portion of the sole 36. Thus, both of the forward strap portions 44 and 50, as well as the two part strap portion 56 bear downwardly on the metatarsal surface of the foot and also on the surface at or near the metatarsal/toe surface to urge the sole 36 into firm contact with the bottom surface of the person's foot.

To facilitate further description of this first embodiment, the sandal 12 shall be considered as having an upper support surface 76, a front end portion 78 with a rounded front edge 80, and forward support portion 82. The sandal 12 further has a rear end portion 84 having a rounded rear upper edge 86 and a rear support surface portion 88.

With reference to FIG. 3, there will now be a description of the fin member 10. This fin member 10 is in this particular embodiment made of a flat plastic material that is moderately flexible and has a planar configuration. This fin member 10 comprises a rear mounting portion 90 by which the fin member 10 is mounted to the sandal 12 and a forward fin portion 92 which accomplishes the swim assist function when the person is swimming and paddling his feet. The fin member 10 can be considered as having a longitudinal center axis 93 extending in a forward to rear direction, and a transverse axis 95 which is at right angles to the longitudinal axis 93.

The perimeter of the fin member 10 comprises a rear edge portion 94, a left rear side edge portion 96, a right rear side edge portion 98, a left forward side edge portion 100, a right forward side edge portion 102, and a forward edge portion 104. There are three strap retaining recesses at the edge locations, namely a recess 106 at the connecting location 46, a recess 108 at the connecting location 48, and a recess 110 at the connecting location 52.

The two recesses 106 and 108 each have a configuration where there is a more narrow access opening 114 defined by front and rear access opening surface 115 at the edge of the fin member 12, and an inner expanded retaining region 116 having front and rear retaining region surfaces 117. The width dimension between the surfaces 115 of the narrower access opening 114, indicated by the numeral 118, may be between ¼ to ¾ of the width dimension (indicated at 120) of the greater width inner region 116.

The forward and rear surface portions 117 of each of the recesses 106–110 engage the related strap in such a way that both the forward and rear movement of the strap connecting location at the recesses 106–110 would be restrained. Thus, not only is a side to side or rotational side to side motion of the mounting portion in a horizontal plane restrained, but also a net forward to rear or rear to forward motion of the fin member 10 is restrained. Also, the fin member 10 is secured to the sandal 12 in a manner that even if the person's foot is removed from the sandal 12, the fin member 10 remains attached to the sandal 12 until such time as the straps are removed out of their respective recesses 106–110.

The dimensions of each of these recesses 106–110 is related to the width dimension and the stiffness of the particular strap portion that is to fit in that recess. The greater width dimension indicated at 120 usually should be sized so that it would be moderately smaller than the width dimension of or approximately equal to the strap that fits in that inner region 116 so that the strap would have a frictional fit in the opening that would give at least moderate resistance to any up and down motion of the strap in that opening. Then the narrower width dimension at 118 would be sufficiently small so that it would be a substantial impediment to movement of the strap out of from the opening 106–110. Yet, the dimension 18 of the access opening 114 must be sufficiently large so that the strap member could be manipulated through (i.e. into and from) the larger inner region 116 by passing through narrow access opening 114.

Thus, when the strap portion 44 is positioned in the recesses 106 and 108, and when the strap 50 is positioned in the recess 110, these two straps 44 and 50 are held in a friction fit in those recesses rather reliably, but not so tightly as to prevent a person from manually moving the strap in the recess. Thus, when the fin member 10 is positioned so that the mounting portion 90 lies flat against the upper forward surface portion of the sole 36, forward to rear movement and side to side movement of the fin member 10 relative to the sole 36 is resisted. Further, twisting of the fin member 10 relative to the sole 36 in a horizontal plane is also resisted.

Also, when the person's foot is positioned in the sandal 12, and the strap portions of the strap assembly are pulled tight so as to hold the ball of the foot firmly against the top surface of the mounting portion 90 of the fin member 10, the fin member 10 is held tightly against the forward part of the sole 36 so as to function as though it were firmly attached to the sole 36. Further, when the foot 14 is removed from the sandal 36, there is sufficient frictional engagement of the strap portions 44 and 50 so that the fin member 10 remains attached to the straps 44 and 50, and remains positioned so that the rear mounting portion is in proximity with the upper forward portion of the sole 36 of the sandal 12.

When it is desired to remove the fin member 10 from the sandal 12, the strap portions 44 and 50 may be loosened to some extent so that they can be manipulated more easily, and then these are moved out of their respective openings 106–110 to separate the fin members 10 from the sandal 12. In general, these strap portions 44 and 50 that are used in sandals that are currently available have sufficient flexibility so that they can be bent along a lengthwise axis of the strap portion to a narrower width dimension and then manipulated out through the outer narrow portion 114 of the recess, and are sufficiently stiff so that in normal use they are reliably secured to the sandal 12.

There will now be a discussion of some of the dimensional relationships in this first embodiment with reference to FIG. 2. As indicated previously, the sandal 12 which is shown in FIGS. 1 and 2 is a commercially available sandal, so the relative dimensions in FIG. 2 that are discussed below are to a large extent dependent on the dimensions of the sandal 12. Of course, the style of the sandal 12 could possibly change, so these dimensional relationships could also change to accommodate these variations.

As shown in FIG. 2, in this particular configuration the total length of the sole 36 of the sandal 12 (indicated at 122) will, for example, be considered as being ten inches. The location of the fin member 10 relative to the sole 36 of the sandal 12 is dictated in large part to the connecting locations 46 and 48 of the strap 44 and the connecting location 52 of the strap 50. The dimension from the front edge of the sole 36 of the sandal 12 to a central location of the edge recess 106 (indicated at 124) may be approximately 45% to 50% of the dimension at 22 (i.e. four and a half to five inches), or possibly 40% to 60% or 35% to 65% or as much as 75%. The dimension indicated at 126 from the forward edge of the sole 36 to the center of the connecting location 52 would be approximately ⅓ of the total distance 122 or possibly between ½ to ¼ of the distance 122. The dimension 128 from the front edge of the sole to the center of the location 48 is as shown about ¼ of the distance 122 but could be, for example 15% to 35% or 10% to 50%. The dimension 130 from the front end of the sole 36 to a middle portion of the rear edge 94 of the fin member 10 is about one half of the total distance 122 from the back edge to the front edge of the sole 36, but could be, for example 55% to 45%, or 60% to 40% or 75% to 25% or possibly longer or shorter.

The dimension 132 from the forward edge of the sole 36 to the outer end of the fin member 10 is approximately 30% to 35% of the dimension 122 which is the total length of the sole 36 of the sandal 12 (i.e. about 3 to 3½ *inches*), assuming the sole 36 of the sandal 12 being about 10 inches. Obviously, this length dimension 132 can vary substantially, depending upon various factors such as how much surface area the person wants to have for the forward fin portion 92. These dimensions can increase and decrease depending on the size of the sandal. Also the dimensional relationships could possibly vary by 5%, 10%, 15%, 20%, 30% or 50% up or down, and possibly by greater amounts.

A second embodiment of the present invention will now be described with reference to FIGS. 4 and 5. Components of the second embodiment which are similar to components of the first embodiment will be given like numerical designations, with "a" suffix distinguishing those of this second embodiment. The sandal 12*a* comprises a sole 36*a* having a strap assembly 38*a*. The sole 36*a* is or may be substantially the same in terms of length, stiffness, overall configuration, etc. to the sole 36 of the first embodiment. The strap assembly 38*a* serves essentially the same basic functions as the strap assembly 38 of the first embodiment, but has a somewhat different strap arrangement.

Figure 4:
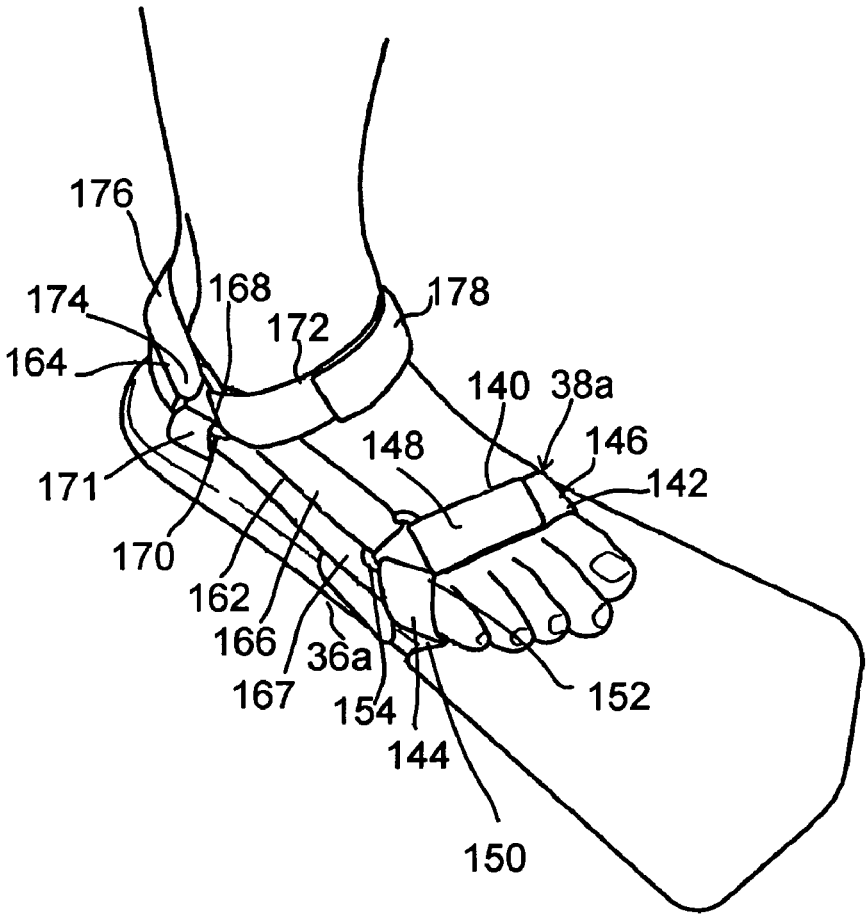
FIG. 4 is an isometric view similar to FIG. 1, showing a second embodiment of the present invention.

With reference first to FIG. 4, the strap assembly 38*a* comprises a front two part strap 140, having two front strap portions 142 and 144. The first strap portion 142 has a left connecting end 146 that connects to an adjacent edge of the sole 36*a*, and a free end portion 148.

The second strap portion 144 has a side connecting end 150 that connects to a right edge portion of the sole 36*a* and second end connecting portion 152 which connects to a closed connecting ring 154. The first strap portion 142 is connected to the second strap portion 144 by moving the free end portion 148 of the first strap portion 142 through the connecting ring 154 and moving the free end of the strap portion 142 back over on itself. The first strap portion 142 has Velcro surfaces which connect to one another as illustrated in FIG. 4.

There is a two piece middle and rear strap portion 160, having first and second strap portions 162 and 164. The first strap portion 162 comprises a forward to rear strap portion 166 having a forward end connecting portion 167 that is formed in a connecting loop to connect to the forward ring 154. The forward to rear strap portion 166 has an intermediate loop portion 168 which loops around a second connecting ring 170 that connects by a looped member 171 to a rear side portion of the sole 38*a*. After looping around the connecting ring 170, the first strap portion 162 extends upwardly over the rear upper surface portion as a rear upper foot surface engaging strap portion 172.

The second strap portion 164 has a first connecting end 174 that connects to the connecting ring 170 and extends as a back strap portion 176 around the back of the heel and then along the left side of the heel to make a connection at the left rear side of the sole 36*a* and then continues on in a forward and upward direction over the left side of the ankle and crossing over at 178 to join to the rear upper foot surface engaging portion 172 of the first strap portion 162, so that the two strap portions 172 and 178 function together as a combined rear upper foot engaging strap portion 172/178. This connection can also be accomplished by a Velcro connection.

Figure 5:
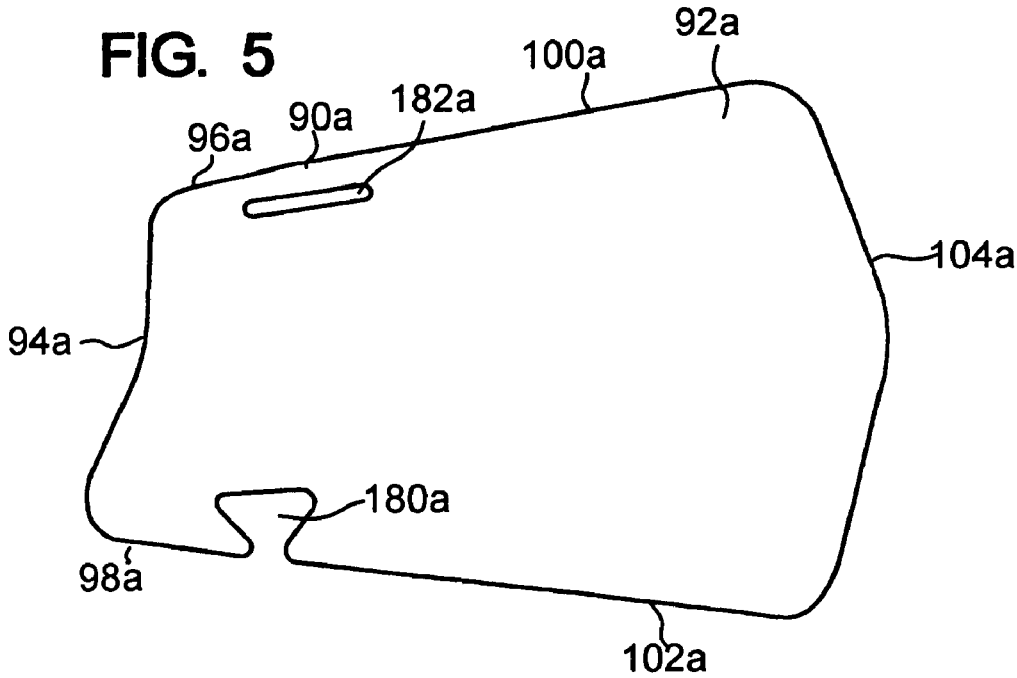
FIG. 5 is a plan view similar to FIG. 3, showing the fin member of the second embodiment.

Reference is now made to FIG. 5 to describe the fin member 10*a* of the second embodiment. As in the first embodiment, the fin member 10*a* has the rear mounting portion 90*a* in the forward fin portion 92*a*. Also, it has substantially the same edge portions, namely, the rear edge portion 94*a*, the left rear edge portion 96*a*, the right rear edge portion 98*a*, the left forward edge portion 100*a*, the left forward side portion 102*a*, and the forward edge portion 104*a*.

The configuration of the connecting recesses of this second embodiment are somewhat different from the first embodiment. At the left side, there is a recess 180*a* on the right edge portion of the fin member 10*a* which has substantially the same configuration as the recess at 52*a*, and this is positioned to engage the forward second strap portion 144 of the front two piece strap 140.

At the left rear edge portion of the fin member 10*a*, there is a closed recess 182*a* which is formed as an elongate slot just inside the left rear edge portion 94*a*. The free end 148 of the strap portion 142 is inserted through this slot-like opening 182*a* so that it can be moved to it's fastening position as shown in FIG. 4.

It is believed that the various functions of the strap assembly 38*a* and of the fin member 10*a* are readily apparent from reviewing the text and drawings (FIGS. 1–3) disclosing the first embodiment. The fin member 10*a* functions in substantially the same way as the fin member 10 of the first embodiment. The forward two piece strap 140 serves substantially the same function as the two forward strap portions 44 and 50 of the first embodiment in holding the forward portion of the metatarsus of the foot against the mounting portion 90*a* of the fin member 10*a*. The rear upper foot surface engaging portion 172 serves the same basic function as the rear upper foot surface engaging portion 56 of the first embodiment.

Figure 6:
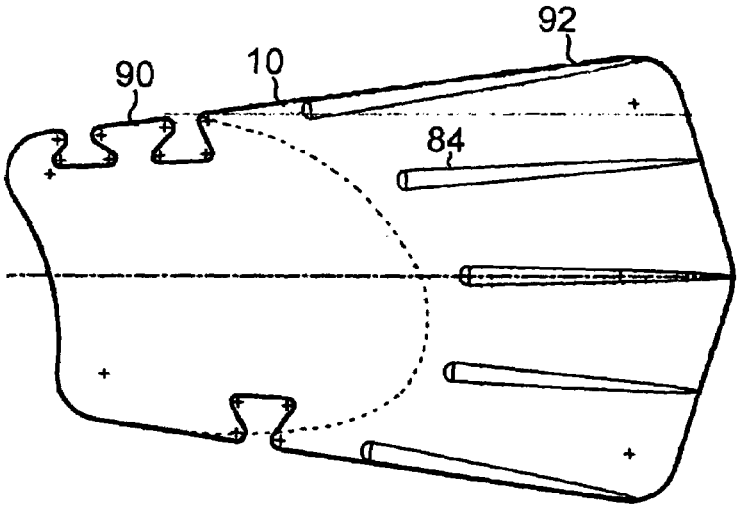
FIG. 6 is a plan view showing a somewhat modified version of the fin member of the first embodiment.

A somewhat modified configuration of the fin member 10 of the first embodiment is shown in FIG. 6. This is a fin member 10 which fits the left foot, and it differs from the fin member 10 shown in FIGS. 1–3 in that there is added to the forward fin portion 94 five reinforcing ribs 184 extending generally in a forward to rear direction, but diverging slightly in the forward direction to match the overall contour of the fin member 10.

Figure 7:
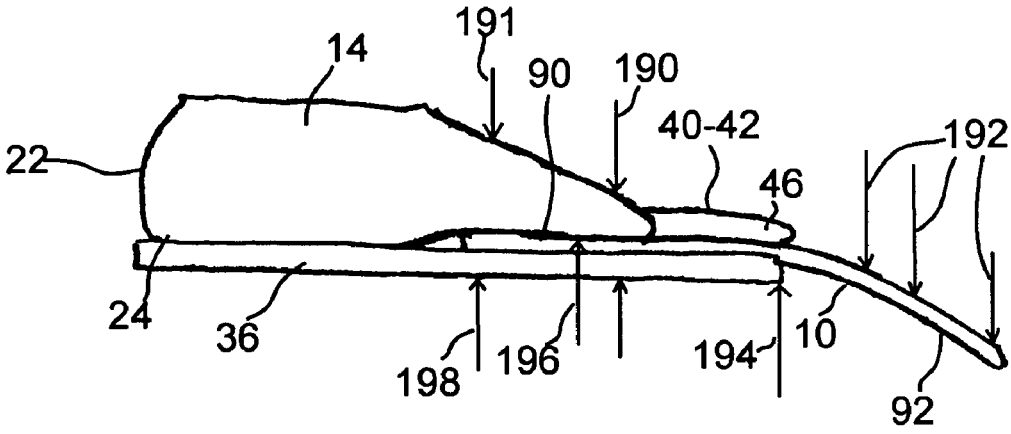
FIGS. 7 and 8 are somewhat schematic side elevational views illustrating the sole of the sandal, the person's foot and the fin member and also showing various force relationships during the swimming motion.
Figure 8:
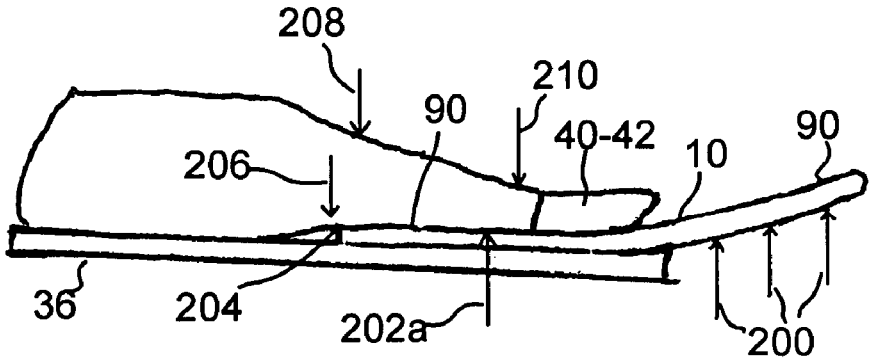

To discuss operating features of the embodiments of the present invention reference is made to FIGS. 7 and 8, which show schematically the person's foot 14 and toes 26, the fin member 10, and the sole 36 of the sandal 12. Let us assume that the person has his (her) feet 14 positioned in the two sandals 12 with the two fin members 10 in the positions as shown in FIGS. 1 and 2. When the person is standing on the sandals 12, for example on the beach or in shallow water, the weight of the person is transmitted as a force into the sole 36, and the forward portion of the foot that bears against the mounting portion 90 of the fin member 10 presses the mounting portion 90 against the sole 36.

Then when the person enters the water and starts the swimming motion, generally the person will point the foot in a rearward direction and will then move the lower leg portion back and forth in a paddling motion. At this time, the weight of the person is not transmitted through the foot into the mounting portion 90 of the fin member 10, nor is it pushing against the sole 36 of the sandal 12. Rather, it is only action of the strap assembly 38 that presses the sole 36 against the lower surface of the person's foot. With the arrangement shown in FIGS. 1 and 2 the strap assembly 38 presses downwardly as a force 190 on the upper forward metatarsal surface portion and also as a force 192 on the rear upper foot surface portion, so that substantially the entire foot is pressed downwardly against the sole 36, and with the ball of the foot pressing against the mounting portion 90 of the fin member 10.

With reference to FIGS. 7 and 8 let us now look at the effect of the force 192 of the water when the person is moving the lower leg portion back and forth in a paddling motion. In FIG. 7, the foot 14 is shown being moved in a forward direction (relative to the person's body), and the force of the water on the forward fin portion 92 is indicated by the arrows 194. This causes the forward fin portion 92 to bend downwardly, and these forces 192 are reacted at the front edge of the sole 36 at the location indicated by the arrow 196. The location at 196 acts as a fulcrum of the forward fin portion 92 and causes the mounting portion 90 of the fin member 10 at the ball of the foot to push upwardly against the ball of the person's foot, and this force is indicated by the arrow 196 and also at 198. This force 196 is directed to move the ball of the foot away from the sole 36, but this is restrained by the forward strap portions 44, 50 and 56, as shown in FIG. 7 by reacting to the forces at 190 and 192.

It will be recalled that earlier in this text, it was pointed out that the fin member 10 has the connections to the straps at the connecting locations 46, 48 and 52 of the sole 36. Accordingly, the forward to rear motion and side to side motion of the fin member 10 are restrained, and any twisting motion of the fin member 10 about a horizontal plane (relative to the sole 36) is also restrained. There is only very moderate motion permitted due to some yielding in the strap 44 and 50. Also, with the straps 44 and 50 and 56 being reasonably tight, there is very little, if any, lift to move the mounting portion 90 of the fin member 10 away from the sole 36. Thus, any force that has a lateral force component (for example, resulting from the person possibly tilting the foot one way or the other so that the force of the water 194 would have a lateral force component) would essentially have lateral movement or a rotating lateral movement of the fin member 10 restraint relative to the sole 36 of the sandal and also relative to the person's foot 14.

Let us now turn our attention to FIG. 8, which shows the situation where the person is moving his (her) leg in a rearward direction in the swimming motion, and that in this instance, the force of the water, as indicated by the arrows 200 is urging the forward fin portion 92 in a forward direction (an upward direction as seen in FIG. 8). This causes the forward fin portion 92 to bend upwardly, and it is assumed that the person's toes 26 would be giving only moderate resistance to the force exerted by the bending of the forward fin portion 92. Rather, the bending of the forward fin portion 92 would be transmitted into the forward part of the mounting portion 90 and the resultant upward force would be mainly against the ball of the person's foot at the location as indicated by the force at 202 in FIG. 8. In this instance, the ball of the foot would act as a fulcrum, and the middle and rear end portion 204 of the mounting portion 90 of the fin member 10 would be pressing downwardly against the sole 36 of the sandal 12. This force is indicated at 206. It is to be understood that the force 206 would not be exerted only at that precise point, but also through the part of the mounting portion that is between the locations 202 and 204 to pull downwardly on the strap section 56, as indicated by the arrow 208. There is also the force exerted on the forward straps 44 and 46 over the forward part of the metatarsus of the foot as indicated at 210. However, the straps 44, 50 and 56 resist these forces to maintain the fin 10 and the sole 36 together in the proper position. Again, as indicated above, the connections to the straps 44 and 50 resist any forward, rearward, side to side, or rotating motion of the fin member 10 so that it is held in it's proper orientation.

When the person removes the sandals 12 from his feet 14, and it is desired to have the fin members 10 to remain connected to the sandals 12, as indicated previously, the connection of the fin members 10 to the sandal 12 is sufficient to maintain the fin members 10 connected to the sandals 12. Of course, the fin members 10 can readily be removed by simply disconnecting the fin member 10 from the straps which hold it in place.

Let us now review the manner in which the fin members 10 can used in conjunction with the sandal 36, and in the following text, this will be explained relative to the first embodiment, with the understanding that this would apply also to the second embodiment.

First, when the fin member 10 is to be attached to the sandal 36, the rear end of the fin member 10 can be moved from a front to rear direction so that the mounting portion 90 of the fin would be positioned at a forward part of the sandal, and so that the connecting locations 48 and 52 are properly aligned with the corresponding recesses 106, 108, and 110. Then at the connecting locations of the two strap portions 44 and 50 are made by pushing the strap portions through the openings 114 into the broader inner regions 116 of the recesses 106, 108, and 110. This connection is sufficient to retain the fin member connected to the sandal and also to limit relative motion therebetween.

When the person's foot is then moved into the sandal to the operating position, the strap assembly 38 can be tightened down. The force of the more forward strap portions 44 and 50 maintain the forward metatarsal portion of the foot pressing downwardly on the mounting portion 99 which in turn presses downwardly on the forward part of the sole 36 and also pulling the forward part of the sole upwardly. The rear upper foot surface engaging strap portion 56 functions similarly on the sole 36 to maintain that portion of the sole properly engaging the foot 14, so that the person's foot 14, the sandal 12, and the fin member 10 function as a unit. The forward to rear positioning of the fin member 10 is controlled by the interconnection of the two end portions of the strap 44 in their respective recesses 108 and 110, and with the forward connecting end of the strap portion 50 being engaged in its recess 52, this limits all relative movement between the fin member 10 and the sole 36.

When the fin/sandal combination is used in paddling through the water, the fin members 10 are kept in proper position in alignment by the interaction of the mounting portion 90 to fin member 10 acting at the forward part of the sole 36. Since this is described in more detail earlier in this text, this will not be repeated in this portion of the text.

Then when the sole with the fin member 10 is removed from the person's foot, the fin member can easily be removed from the sandal 12.

Alternatively, if it is desired to leave the fin members connected to the sandals 12, then the connection between the fin members 10 and the soles 12 is adequate to accomplish this. The sandals 12 could be grasped with the fin members 10 hanging free, or the fin members 10 could be grasped with the sandals 12 being free, and these would remain secured together, either for carrying to a location, being stored temporarily or simply carried for reuse at a later time.

Various modifications could be made to the embodiments of the invention without departing from the basic teachings of the present invention.

I claim:

1. A fin member adapted to be connected to a person's footwear where the footwear has a sole comprising a forward sole portion to engage a forward portion of the person's foot and a rear sole portion to engage a rear portion of the person's foot, and a strap assembly which is arranged to retain the foot on the sole and which comprises at least a forward strap portion that has first and second strap connecting portions that engage at least first and second opposite side portions of the sole at first and second side connecting locations of the sole, said fin member comprising:

a) a rear fin mounting section which is arranged to be connected in an operating position to the forward sole portion, said fin mounting section having first and second side strap engaging recesses which, in the operating position, are located at the first and second side connecting locations and arranged to receive the first and second strap connecting portions of the forward strap portions in retaining positions in a manner that with a person's foot positioned in the footwear, the fin mounting section is positioned between an upper forward surface portion of the sole and the forward portion of the person's foot;

b) a forward fin section which is connected to, and extends forwardly from, said fin mounting portion;

c) said strap engaging recesses each comprising forward and rear retaining region surfaces to position to restrain forward and rear movement of the strap connecting portion located in that strap engaging recess whereby with the fin member in its operating position and with a person's foot positioned on the sole and with the retaining strap section retaining the foot, and with strap connecting portions retained in the first and second strap retaining recesses, lateral and/or front to rear movement of the fin member relative to the sole is restrained.

2. The fin member as recited on claim 1, wherein at least one of said recesses comprises an access opening leading into its recess and arranged to receive one of said strap connecting portions.

3. The fin member as recited on claim 1, wherein at least one of said recesses comprises an access opening leading into the recess and having access opening surfaces spaced from one another by a lesser distance than a distance between the front and rear retaining region surfaces.

4. The fin member as recited in claim 3, wherein the distance between the access opening surfaces is no greater than three quarters of the distance between the front and rear retaining region surfaces.

5. The fin member as recited in claim 4, wherein the distance between the access opening surfaces is no greater than one half of the distance between the front and rear retaining region surfaces.

6. The fin member as recited in claim 1, wherein at least one of said recesses is a closed recess which substantially surrounds the strap connecting portion.

7. The fin member as recited in claim 6, wherein said closed recess has a configuration where a width dimension of the closed recess is substantially smaller than its length dimension.

8. The fin member as recited in claim 1, wherein there is at least three side strap engaging recesses to engage at least two forward strap portions.

9. The assembly as recited in claim 1, wherein there is at least three side strap engaging recesses to engage at least two forward strap portions.

10. A footwear and fin member assembly wherein:

a) said footwear comprises a forward sole portion to engage a forward portion of the person's foot and a rear sole portion to engage a rear portion of the person's foot, and a strap assembly which is arranged to retain the foot on the sole and which comprises at least a forward strap portion that has first and second strap connecting portions that engage at least first and second opposite side portions of the sole at first and second side connecting locations of the sole;

b) said fin member comprising:

i. a rear fin mounting section which is arranged to be connected in an operating position to the forward sole portion, said fin mounting section having first and second side strap engaging recesses which, in the operating position, are located at the first and second side connecting locations and arranged to receive the first and second strap connecting portions of the forward strap portions in retaining positions in a manner that with a person's foot positioned in the footwear, the fin mounting section is positioned between an upper forward surface portion of the sole and the forward portion of the person's foot;

ii. a forward fin section which is connected to, and extends forwardly from, said fin mounting portion;

iii) said strap engaging recesses each comprising forward and rear retaining region surfaces to position to restrain forward and rear movement of the strap connecting portion located in that strap engaging recess;

whereby with the fin member in its operating position and with a person's foot positioned on the sole and with the retaining strap section retaining the foot, and with strap connecting portions retained in the first and second strap retaining recesses, lateral and/or front to rear movement of the fin member relative to the sole is restrained.

11. The assembly as recited on claim 10, wherein at least one of said recesses comprises an access opening leading into its recess and arranged to receive one of said strap connecting portions.

12. The assembly as recited on claim 10, wherein at least one of said recesses comprises an access opening leading into the recess and having access opening surfaces spaced from one another by a lesser distance than a distance between the front and rear retaining region surfaces.

13. The assembly as recited in claim 12, wherein the distance between the access opening surfaces is no greater than three quarters of the distance between the front and rear retaining region surfaces.

14. The assembly as recited in claim 13, wherein the distance between the access opening surfaces is no greater than one half of the distance between the front and rear retaining region surfaces.

15. The assembly as recited in claim 10, wherein at least one of said recesses is a closed recess which substantially surrounds the strap connecting portion.

16. The assembly as recited in claim 15, wherein said closed recess has a configuration where a width dimension of the closed recess is substantially smaller than its length dimension.

17. A method of providing a footwear and fin member and connecting these in an assembly to be connected to a person's foot, said method comprising:

a) providing a footwear which has a sole comprising a forward sole portion to engage a forward portion of the person's foot and a rear sole portion to engage a rear portion of the person's foot, and a strap assembly which is arranged to retain the foot on the sole and which comprises at least a forward strap portion that has first and second strap connecting portions that engage at least first and second opposite side portions of the sole at first and second side connecting locations of the sole;

b) providing a fin member comprising:

i. a rear fin mounting section which is arranged to be connected in an operating position to the forward sole portion, with said fin mounting section having first and second side strap engaging recesses which, in the operating position, are located at the first and second side connecting locations and arranged to receive the first and second strap connecting portions of the forward strap portions in retaining positions in a manner that with a person's foot positioned in the footwear, the fin mounting section is positioned between an upper forward surface portion of the sole and the forward portion of the person's foot; and ii. a forward fin section which is connected to, and extends forwardly from, said fin mounting portion;

c) further providing said strap engaging recesses in a manner that each of said recesses comprises forward and rear retaining region surfaces arranged to be positioned to restrain forward and rear movement of the strap connecting portion located in that strap engaging recess;

d) placing said fin member in its operating position and positioning the strap connecting portions in secured positions in the first and second strap retaining recesses;

whereby with the fin member in its operating position the person's foot is able to be positioned on the sole and with the retaining strap section retaining the foot, and with strap connecting portions retained in the first and second strap retaining recesses, lateral and/or front to rear movement of the fin member relative to the sole is restrained.

18. The method as recited on claim 17, wherein at least one of said recesses comprises an access opening leading into its recess and arranged to receive one of said strap connecting portions.

19. The method as recited on claim 17, wherein at least one of said recesses comprises an access opening leading into the recess and having access opening surfaces spaced from one another by a lesser distance than a distance between the front and rear retaining region surfaces.

20. The method as recited in claim 17, wherein there are at least three side strap engaging recesses to engage at least two forward strap portions.

* * * * *